US010815729B2

(12) United States Patent
Bowling et al.

(10) Patent No.: US 10,815,729 B2
(45) Date of Patent: Oct. 27, 2020

(54) LADDER LANDING SUPPORT APPARATUS

(71) Applicant: thyssenkrupp Elevator Innovation and Operations GmbH, Essen (DE)

(72) Inventors: William E. Bowling, Bloomington, IN (US); Zachary William Evans, Cordova, TN (US)

(73) Assignee: thyssenkrupp Elevator Innovation & Operations GmbH, Essen (DE)

( * ) Notice: Subject to any disclaimer, the term of this patent is extended or adjusted under 35 U.S.C. 154(b) by 0 days.

(21) Appl. No.: 15/862,254

(22) Filed: Jan. 4, 2018

(65) Prior Publication Data

US 2019/0203534 A1 Jul. 4, 2019

(51) Int. Cl.
*E06C 7/18* (2006.01)
*E06C 7/42* (2006.01)

(52) U.S. Cl.
CPC ..... *E06C 7/188* (2013.01); *E06C 7/42* (2013.01)

(58) Field of Classification Search
CPC ... E06C 7/188; E06C 7/42; E06C 7/44; E06C 7/46; E04G 5/02; E04G 5/025
See application file for complete search history.

(56) References Cited

U.S. PATENT DOCUMENTS 3,096,939 A 7/1963 Kalfen
3,618,703 A * 11/1971 Wilke ..... E06C 7/42 182/107
3,836,075 A 9/1974 Botbol
4,846,305 A * 7/1989 Kupfert ..... E06C 7/42 182/97
5,078,231 A * 1/1992 Davis ..... E06C 7/42 182/107
5,204,159 A 4/1993 Tan
5,339,921 A * 8/1994 Faupel ..... E04D 15/00 182/111
5,558,306 A * 9/1996 Binford ..... B44D 3/14 248/148
5,967,261 A * 10/1999 Sandham ..... E06C 7/44 182/200
6,053,284 A * 4/2000 Fountain ..... E06C 7/42 182/180.2
6,547,036 B1 * 4/2003 Carter ..... E06C 7/426 182/200

(Continued)

FOREIGN PATENT DOCUMENTS

EP 0329422 8/1989
EP 1647512 A1 4/2006

(Continued)

*Primary Examiner* — Katherine W Mitchell
*Assistant Examiner* — Shiref M Mekhaeil
(74) *Attorney, Agent, or Firm* — The Webb Law Firm

(57) ABSTRACT

A ladder landing support apparatus includes an angled base plate including a first portion and a second portion defining an angle with the first portion, and a ladder engaging part extending upwardly from a top side of the first portion, the ladder engaging part being engageable with feet of a ladder so as to substantially prevent slippage thereof in a direction parallel to the first portion, wherein the angled base plate is angled to engage a ledge such that the first portion is engageable with a top horizontal surface of the ledge and the second portion is engageable with a front vertical surface of the ledge.

17 Claims, 7 Drawing Sheets

(56) References Cited

U.S. PATENT DOCUMENTS

| | | | | |
|---|---|---|---|---|
| 6,655,497 | B1 * | 12/2003 | Weatherall | E06C 7/426 182/108 |
| 7,108,100 | B2 | 9/2006 | Stingl | |
| 8,042,651 | B1 * | 10/2011 | Michnik | E06C 1/14 182/107 |
| 8,382,056 | B2 * | 2/2013 | Le Masurier | E06C 7/426 182/2.2 |
| 8,393,586 | B1 * | 3/2013 | Mercure | E06C 7/426 182/180.3 |
| 8,418,809 | B2 * | 4/2013 | Donlon | E06C 7/46 182/111 |
| 8,684,138 | B1 * | 4/2014 | Marsh, II | E06C 7/188 182/116 |
| 9,359,820 | B2 * | 6/2016 | Markley | E06C 7/46 |
| 9,810,023 | B2 * | 11/2017 | Stewart | E06C 7/426 |
| 2002/0166723 | A1 * | 11/2002 | Huber | E06C 5/24 182/127 |
| 2005/0194214 | A1 * | 9/2005 | Royce | E06C 1/18 182/172 |
| 2006/0124393 | A1 | 6/2006 | Robinson | |
| 2009/0200110 | A1 * | 8/2009 | Esselborn | E06C 7/46 182/107 |
| 2011/0132684 | A1 * | 6/2011 | Wilkins | E06C 7/46 182/107 |
| 2011/0214943 | A1 * | 9/2011 | McElroy | E06C 7/18 182/107 |
| 2012/0199416 | A1 * | 8/2012 | Hopkins | E06C 7/42 182/111 |
| 2013/0119213 | A1 * | 5/2013 | Watson | E06C 7/42 248/201 |
| 2014/0000987 | A1 * | 1/2014 | Peacock | B66B 19/00 187/414 |
| 2015/0197987 | A1 * | 7/2015 | Moselsky | E06C 7/44 182/204 |
| 2016/0348436 | A1 * | 12/2016 | Reyes | E06C 9/08 |
| 2016/0369563 | A1 * | 12/2016 | Adcock | E06C 7/46 |
| 2018/0291686 | A1 * | 10/2018 | Losito | E06C 7/188 |

FOREIGN PATENT DOCUMENTS

| | | | | |
|---|---|---|---|---|
| FR | 2641018 | A1 | 12/1988 | |
| GB | 2452269 | A | 3/2009 | |
| JP | 2-20354 | | 6/1990 | |
| JP | 2682354 | | 8/1997 | |
| JP | 2005089148 | A | 4/2005 | |
| JP | 2006077462 | A | 3/2006 | |
| JP | 2008201495 | A | 9/2008 | |
| WO | 02094700 | A1 | 11/2002 | |
| WO | WO-2016085399 | A1 * | 6/2016 | E06C 7/426 |
| WO | 2017108493 | A1 | 6/2017 | |

* cited by examiner

LADDER LANDING SUPPORT APPARATUS

BACKGROUND

Field

The present disclosure is generally directed to a ladder assembly and, more particularly, to a ladder landing support apparatus used to support a ladder.

Description of Related Art

Ladders are typically used in a wide range of situations. In some situations, a ladder is used by maintenance personnel to install elevator systems or fix or repair mechanical equipment or other technical issues in an elevator hoistway. The elevator hoistway is a vertical passage provided in a building that permits an elevator car to move vertically between different floors or locations in the building. Occasionally, an installation of an elevator system or a mechanical or technical issue in the elevator car and/or elevator hoistway will create the need for maintenance personnel to access the elevator hoistway to address the issue. Maintenance personnel also occasionally need to access the elevator hoistway for routine maintenance on the elevator hoistway and/or elevator car.

To gain access to the elevator hoistway, the maintenance personnel will often secure the feet of a ladder on a landing adjacent to the elevator hoistway and lean the top of the ladder against a wall within the elevator hoistway opposite the landing. The maintenance personnel wear fall protection equipment to prevent injuries in the event the ladder slides or slips on the landing. One maintenance person may press his/her foot against the base of the ladder so as to prevent the ladder from sliding on the landing. However, this is not always the safest for securing the ladder in the elevator hoistway. The maintenance person holding the base of the ladder may become distracted and allow the ladder to slide on the landing. Additionally, the maintenance person may not be strong enough to prevent the ladder from sliding on the landing. Ladder support devices have been developed to hold the base of a ladder to eliminate the need to have a maintenance person hold the base of the ladder. However, none of these ladder support devices have addressed the situation described above in which a ladder is used in an elevator hoistway.

SUMMARY

In view of the foregoing, there is a need for a ladder support apparatus to be used to support a ladder in an elevator hoistway. Further, there is a need for a ladder support apparatus that provides sufficient support to a ladder so as to eliminate the need for maintenance personnel to hold the base of the ladder. There is a further need for a ladder support apparatus that prevents the ladder from losing traction or sliding across a landing upon which the ladder is supported.

In one example of the present disclosure, a ladder support apparatus may include an angled base plate including a first portion and a second portion defining an angle with the first portion; and a ladder engaging part extending upwardly from a top side of the first portion, the ladder engaging part being engageable with feet of a ladder so as to substantially prevent slippage thereof in a direction parallel to the first portion, wherein the angled base is angled to engage a ledge such that the first portion is engageable with a top horizontal surface of the ledge and the second portion is engageable with a front vertical surface of the ledge.

In another example of the present disclosure, the ladder engaging part may be U-shaped including a center portion, a left portion, and a right portion. The left portion and the right portion may extend substantially perpendicular to the center portion. The center portion may define two spaced apart openings to receive at least a portion of the feet of the ladder therethrough. The base plate and the ladder engaging part may be formed as a monolithic structure. The base plate and the ladder engaging part may be separate components that are welded together. The top side of the first portion of the base plate may define at least two spaced apart recesses shaped and configured to receive a foot of a ladder. The first portion may define an angle of approximately 90° with the second portion. At least one slot may be defined in the base plate to receive mechanical fasteners to secure the first portion of the base plate with the top horizontal surface of the ledge. A nonslip grip surface may be formed or provided on a bottom side of the first portion of the base plate.

In another example of the present disclosure, a ladder assembly may include a ladder including two feet; and a ladder support apparatus including an angled base plate including a first portion and a second portion defining an angle with the first portion, and a ladder engaging part extending upwardly from a top side of the first portion, the ladder engaging part being engageable with the feet of a ladder so as to substantially prevent slippage thereof in a direction parallel to the first portion, wherein the angled base plate is angled to engage a ledge such that the first portion is engageable with a top horizontal surface of the ledge and the second portion is engageable with a front vertical surface of the ledge.

In another example of the present disclosure, the ladder engaging part may be U-shaped comprising a center portion, a left portion, and a right portion. The left portion and the right portion may extend substantially perpendicular to the center portion. The center portion may define two spaced apart openings to receive at least a portion of the feet of the ladder therethrough. The base plate and the ladder engaging part may be formed as a monolithic structure. The base plate and the ladder engaging part may be separate components that are welded together. The top side of the first portion of the base plate may define at least two spaced apart recesses shaped and configured to receive one of the feet of the ladder. The first portion may define an angle of approximately 90° with the second portion. At least one slot may be defined in the base plate to receive mechanical fasteners to secure the first portion of the base plate with the top horizontal surface of the ledge. A second ladder landing support apparatus may be provided and configured to be nested within the ladder landing support apparatus.

Further examples will now be described in the following numbered clauses.

Clause 1: A ladder landing support apparatus, comprising an angled base plate including a first portion and a second portion defining an angle with the first portion; and a ladder engaging part extending upwardly from a top side of the first portion, the ladder engaging part being engageable with feet of a ladder so as to substantially prevent slippage thereof in a direction parallel to the first portion, wherein the angled base plate is angled to engage a ledge such that the first portion is engageable with a top horizontal surface of the ledge and the second portion is engageable with a front vertical surface of the ledge.

Clause 2: The ladder landing support apparatus as disclosed in Clause 1, wherein the ladder engaging part is U-shaped comprising a center portion, a left portion, and a right portion.

Clause 3: The ladder landing support apparatus as disclosed in Clause 2, wherein the left portion and the right portion extend substantially perpendicular to the center portion.

Clause 4: The ladder landing support apparatus as disclosed in Clause 2 or 3, wherein the center portion defines two spaced apart openings to receive at least a portion of the feet of the ladder therethrough.

Clause 5: The ladder landing support apparatus as disclosed in any of Clauses 1-4, wherein the base plate and the ladder engaging part are formed as a monolithic structure.

Clause 6: The ladder landing support apparatus as disclosed in any of Clauses 1-5, wherein the base plate and the ladder engaging part are separate components that are welded together.

Clause 7: The ladder landing support apparatus as disclosed in any of Clauses 1-6, wherein the top side of the first portion of the base plate defines at least two spaced apart recesses shaped and configured to receive a foot of a ladder.

Clause 8: The ladder landing support apparatus as disclosed in any of Clauses 1-7, wherein the first portion defines an angle of approximately 90° with the second portion.

Clause 9: The ladder landing support apparatus as disclosed in any of Clauses 1-8, wherein at least one slot is defined in the base plate to receive mechanical fasteners to secure the first portion of the base plate with the top horizontal surface of the ledge.

Clause 10: The ladder landing support apparatus as disclosed in any of Clauses 1-9, further comprising a nonslip grip surface formed or provided on a bottom side of the first portion of the base plate.

Clause 11: A ladder assembly, comprising a ladder comprising two feet; and a ladder landing support apparatus, comprising: an angled base plate including a first portion and a second portion defining an angle with the first portion; and a ladder engaging part extending upwardly from a top side of the first portion, the ladder engaging part being engageable with the feet of a ladder so as to substantially prevent slippage thereof in a direction parallel to the first portion, wherein the angled base plate is angled to engage a ledge such that the first portion is engageable with a top horizontal surface of the ledge and the second portion is engageable with a front vertical surface of the ledge.

Clause 12: The ladder assembly as disclosed in Clause 11, wherein the ladder engaging part is U-shaped comprising a center portion, a left portion, and a right portion.

Clause 13: The ladder assembly as disclosed in Clause 12, wherein the left portion and the right portion extend substantially perpendicular to the center portion.

Clause 14: The ladder assembly as disclosed in Clause 12 or 13, wherein the center portion defines two spaced apart openings to receive at least a portion of the feet of the ladder therethrough.

Clause 15: The ladder assembly as disclosed in any of Clauses 11-14, wherein the base plate and the ladder engaging part are formed as a monolithic structure.

Clause 16: The ladder assembly as disclosed in any of Clauses 11-15, wherein the base plate and the ladder engaging part are separate components that are welded together.

Clause 17: The ladder assembly as disclosed in any of Clauses 11-16, wherein the top side of the first portion of the base plate defines at least two spaced apart recesses shaped and configured to receive one of the feet of the ladder.

Clause 18. The ladder assembly as disclosed in any of Clauses 11-17, wherein the first portion defines an angle of approximately 90° with the second portion.

Clause 19: The ladder assembly as disclosed in any of Clauses 11-18, wherein at least one slot is defined in the base plate to receive mechanical fasteners to secure the first portion of the base plate with the top horizontal surface of the ledge.

Clause 20: The ladder assembly as disclosed in any of Clauses 11-19, further comprising a second ladder landing support apparatus provided and configured to be nested within the ladder landing support apparatus.

These and other features and characteristics of the ladder landing support apparatus, as well as the methods of operation and functions of the related elements of the support apparatus, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only, and are not intended as a definition of the limits of the disclosure. As used in the specification and claims, the singular form of "a", "an", and "the" include plural referents unless the context clearly dictates otherwise.

DETAILED DESCRIPTION

Figure 1:
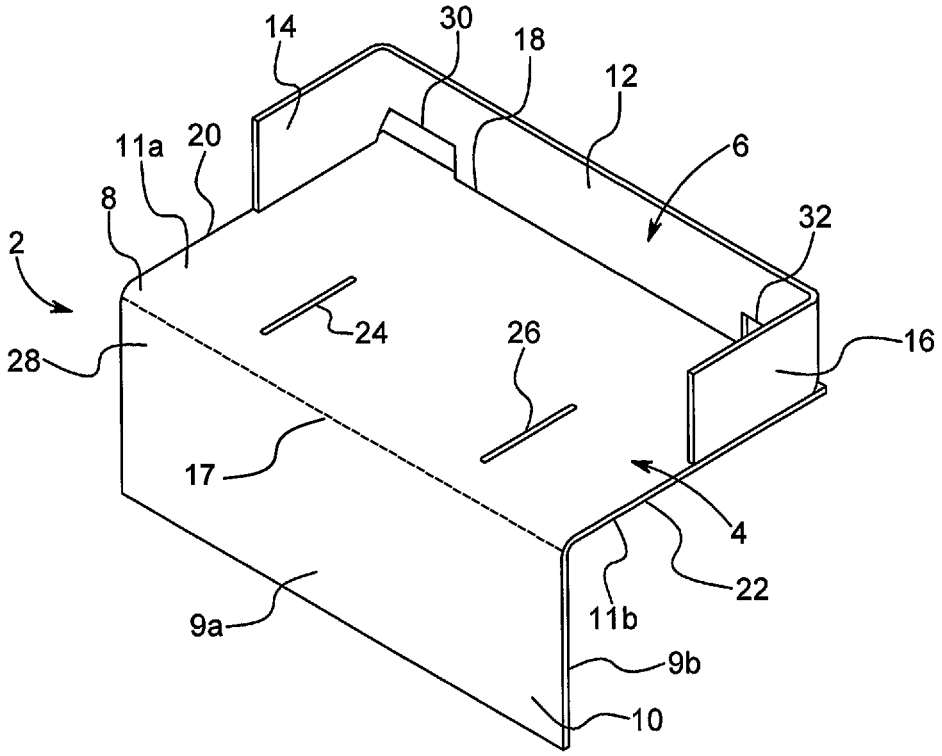
FIG. 1 is a top perspective view of a ladder landing support apparatus according to one example of the present disclosure.
Figure 2:
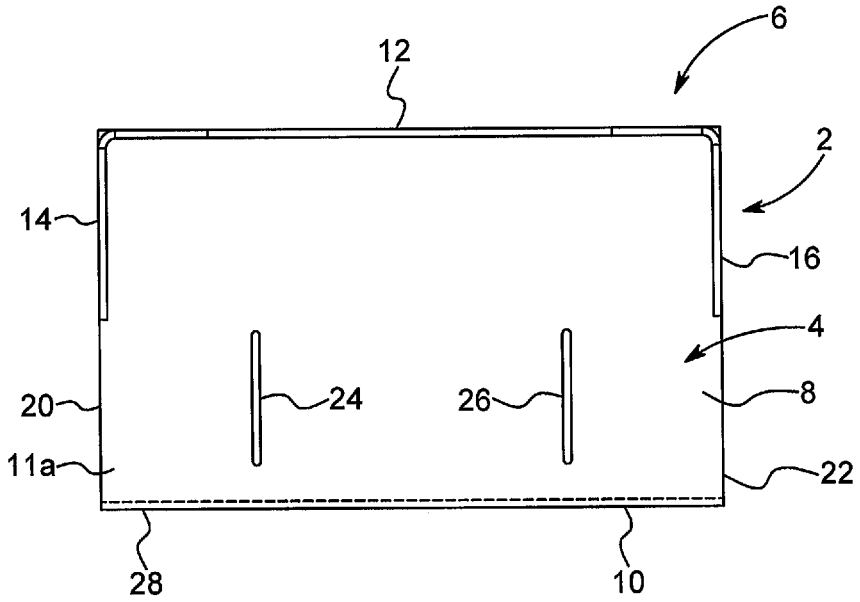
FIG. 2 is a top view of the ladder landing support apparatus of FIG. 1.
Figure 3:
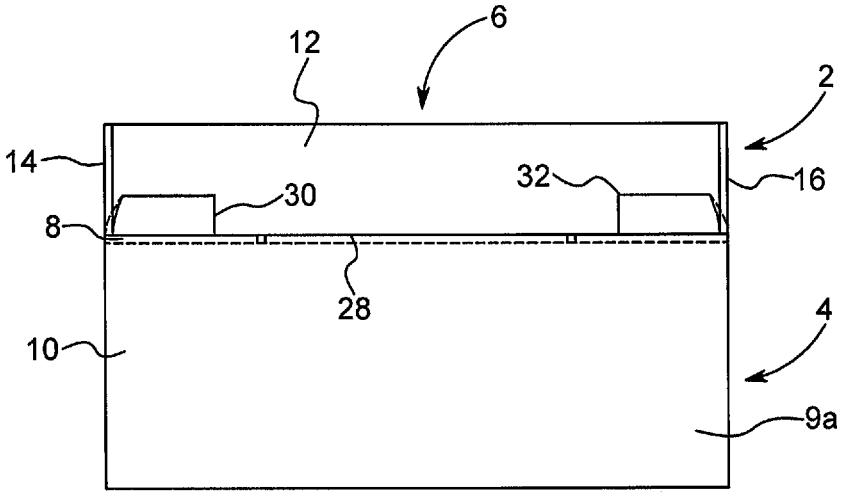
FIG. 3 is a front view of the ladder landing support apparatus of FIG. 1.

For purposes of the description hereinafter, the terms "upper", "lower", "right", "left", "vertical", "horizontal", "top", "bottom", "lateral", "longitudinal", and derivatives thereof, shall relate to the disclosed apparatus as it is oriented in the figures. However, it is to be understood that the apparatus of the present disclosure may assume alternative variations and step sequences, except where expressly specified to the contrary. It is also to be understood that the specific systems and processes illustrated in the attached drawings, and described in the following specification, are simply exemplary examples of the apparatus disclosed herein. Hence, specific dimensions and other physical characteristics related to the examples disclosed herein are not to be considered as limiting.

Referring to the drawings in which like reference numerals refer to like parts throughout the several views thereof, the present disclosure is generally directed to a ladder support apparatus and, more particularly, to a ladder landing support apparatus configured for supporting the feet of a ladder used in an elevator hoistway. It is to be understood, however, that the ladder landing support apparatus may be used in many different settings other than an elevator hoistway where support is needed to hold the base of a ladder that is being held in a standing position.

With reference to FIGS. 1-4, a ladder landing support apparatus 2 (hereinafter "support apparatus 2") according to one example of the present disclosure is shown and described. The support apparatus 2 includes an angled base plate 4 and a ladder engaging part 6 extending upwardly from the base plate 4. In one example, the support apparatus 2 is formed as a monolithic structure. In another example, the support apparatus 2 is formed by welding, fastening, adhesively attaching, or otherwise mechanically connecting the base plate 4 to the ladder engaging part 6. In one example, the support apparatus 2 is made of metal, such as HRS ASTM A36. In other examples, the support apparatus 2 may be made of any other material with a sufficient yield strength to hold the ladder.

The base plate 4 includes a first portion 8 and a second portion 10 that extend substantially perpendicular to one another. In one embodiment, the second portion 10 is disposed at an angle of about 90° relative to the first portion 8. The first portion 8 may extend substantially horizontally and the second portion 10 may extend substantially vertically when in use. Each portion 8, 10 may be substantially rectangular. It is also contemplated, however, that the portions 8, 10 may have alternative shapes, such as trapezoidal, circular, or triangular, among other shapes. In one example, the first and second portions 8, 10 may be formed as a single piece to form a monolithic base plate 4. The second portion 10 may include a front side 9*a* and a rear side 9*b*. The first portion 8 may include a front edge (17) (also referred to as a first end), a top side 11*a* and a bottom side 11*b*.

The ladder engaging part 6 may be U-shaped and include a center portion 12, a left portion 14, and a right portion 16 that extend from the second portion 10 of the base plate 4. In one example, the center portion 12, the left portion 14, and the right portion 16 extend vertically upward from the first portion 8 of the base plate 4 so that the center portion 12, a left portion 14, and a right portion 16 extend substantially perpendicular to the first portion 8 of the base plate 4. In one example, the center portion 12 extends upward from a rear edge 18 (also referred to as the second end) of the first portion 8 of the base plate 4. The left portion 14 extends upward from a left edge 20 of the first portion 8 of the base plate 4, and the right portion 16 extends upward from a right edge 22 of the first portion 8 of the base plate 4. The left portion 14 and the right portion 16 extend substantially perpendicular relative to the center portion 12. In the example of the present disclosure in which the ladder engaging part 6 is welded or otherwise connected to the base plate 4, the bottom surfaces of each of the center portion 12, the left portion 14, and the right portion 16 may be welded or mechanically connected to the top side 11*a* of the first portion 8 of the base plate 4. In one example, the center portion 12, the left portion 14, and the right portion 16 may be formed as a single piece to form a monolithic ladder engaging part 6.

With continued reference to FIGS. 1-4, according to one example of the present disclosure, the first portion 8 of the base plate 4 may define a pair of slots 24, 26. The two slots 24, 26 may alternatively be defined in the second portion 10. It is also contemplated that less (e.g., one) or additional slots (e.g., three or more) may be defined in the first portion 8. The slots 24, 26 extend in a direction extending between the front 28 of the first portion 8 toward the rear edge 18 of the first portion 8. The slots 24, 26 are generally configured to receive mechanical anchors (not shown) that are inserted into the landing to assist in holding the support apparatus 2 to a hoistway landing. Due to the length of the slots 24, 26, there are many different locations along the length of the slots 24, 26 in which the anchors can be inserted to eliminate the need for the maintenance personnel to precisely insert the anchors into a small opening.

Figure 4:
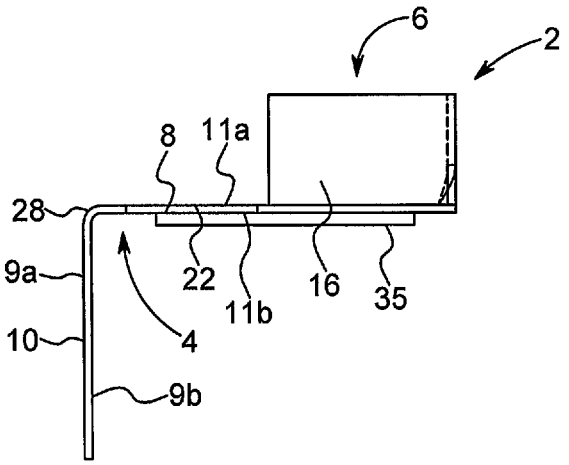
FIG. 4 is a side view of the ladder landing support apparatus of FIG. 1.
Figure 5:
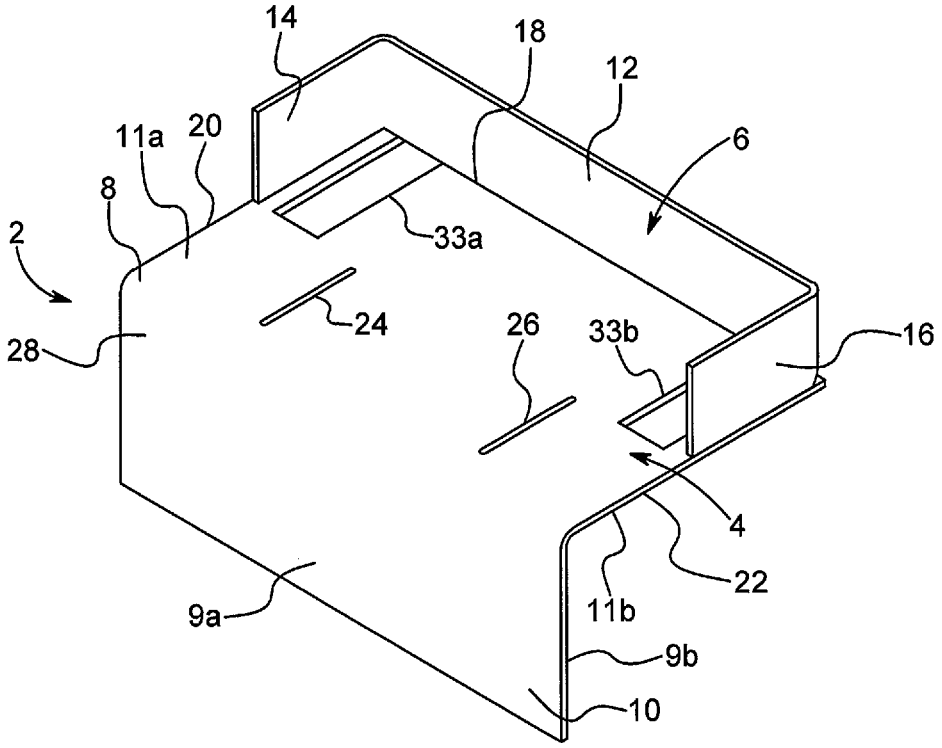
FIG. 5 is a top perspective view of a ladder landing support apparatus according to another example of the present disclosure.
Figure 6:
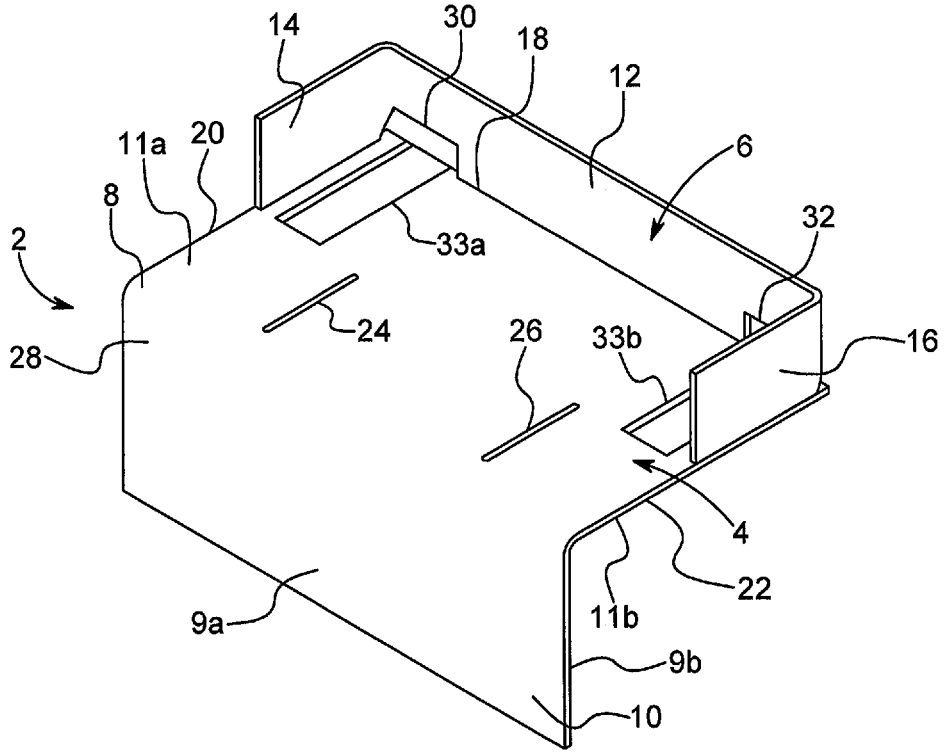
FIG. 6 is a top perspective view of a ladder landing support apparatus according to another example of the present disclosure.
Figure 7:
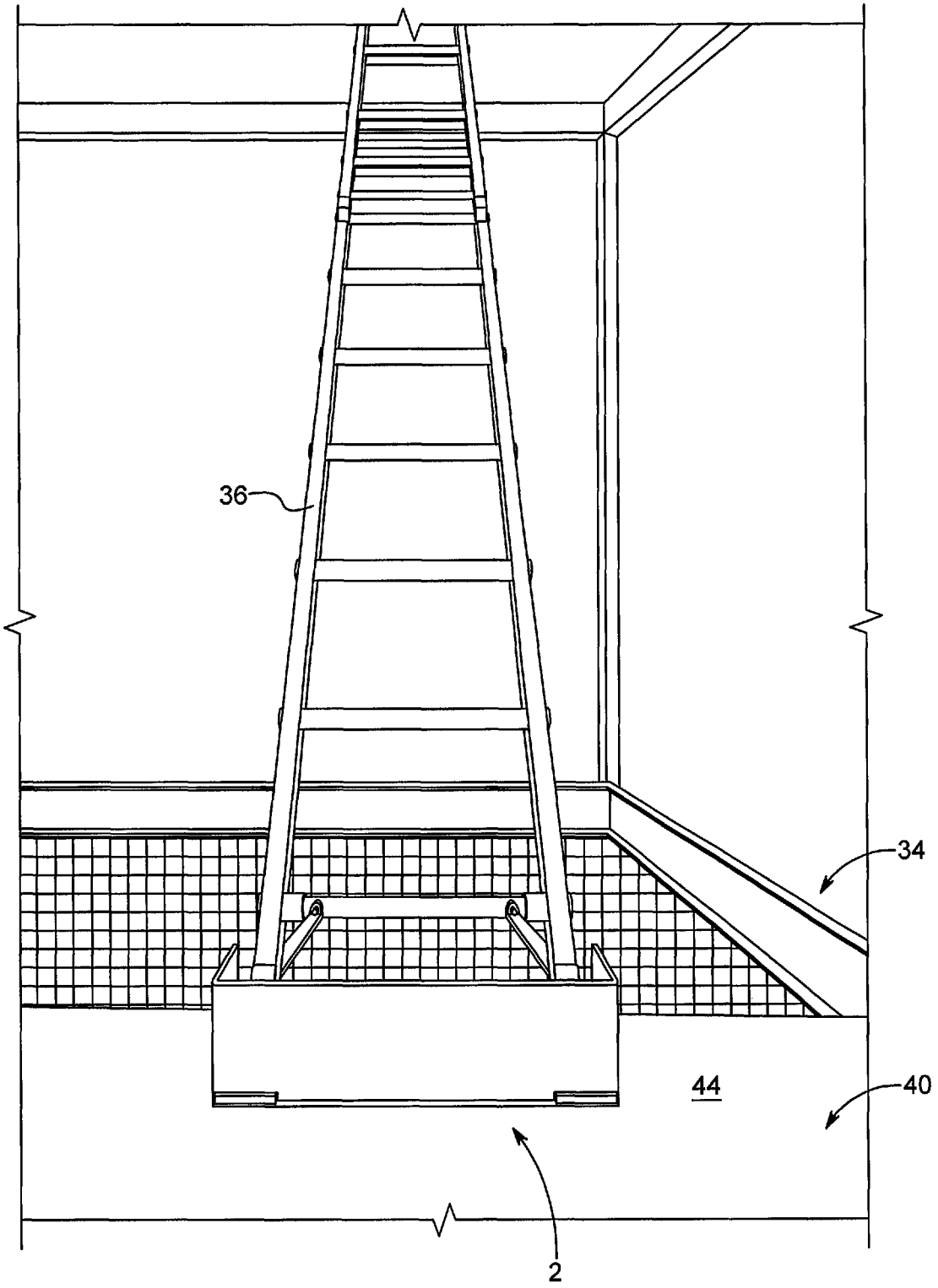
FIG. 7 is a rear view of the ladder landing support apparatus of FIG. 1 supporting a ladder in an elevator hoistway.

In another example of the support apparatus 2, the center portion 12 may define two spaced apart openings 30, 32 to receive the feet of a ladder therethrough. The openings 30, 32 may form substantially rectangular openings for the feet. As mentioned, the openings 30, 32 may be sized and shaped to receive the feet of a ladder that is supported by the support apparatus 2. In another example of the support apparatus 2, shown in FIGS. 5 and 6, the top side 11*a* of the first portion 8 of the base plate 4 may define two spaced apart recesses 33*a*, 33*b*. The recesses 33*a*, 33*b* may be defined to receive the feet of a ladder to aid in positioning the ladder feet relative to the openings 30, 32 and/or restrain the feet laterally and in a front-to-back direction. The feet of the ladder may drop into the recesses 33*a*, 33*b* to prevent movement of the feet of the ladder towards a front end of the base plate 4. It is contemplated that the support apparatus 2 may include only the openings 30, 32 (FIG. 1), only the recesses 33*a*, 33*b* (FIG. 5), or the openings 30, 32 and the recesses 33*a*, 33*b* (FIG. 6). In another example, as shown in FIG. 4, a nonslip grip material 35 may be provided on the bottom side 11*b* of the first portion 8. The nonslip grip material 35 may be applied to the first portion 8 or may be integrally formed with the first portion 8.

With reference to FIGS. 7-11, an example of the support apparatus 2 in use in an elevator hoistway 34 is shown and described. The support apparatus 2 is used to support and hold a ladder 36 that is extended within and across the elevator hoistway 34. As described above, it is often necessary for maintenance personnel to install an elevator frame work system, including, among other components, rigging and guide rails, or fix or repair a mechanical or technical issue in the elevator hoistway 34 or possibly an elevator car (not shown) that requires the maintenance personnel to position the ladder 36 within the elevator hoistway 34 to access the area of the elevator hoistway 34 or elevator car that needs installed or repaired. The feet 38 of the ladder 36 are often positioned on a landing or ledge 40 of the elevator hoistway 34 and the upper portion of the ladder 36 is leaned against an opposing wall in the elevator hoistway 34. Typically, one maintenance person will ascend the ladder 36 to install the component or repair the issue, while a second maintenance person supports the feet 38 of the ladder 36 to prevent the ladder 36 from sliding on the landing 40. To avoid the need for a second maintenance person to support the feet 38 of the ladder 36, the support apparatus 2 can be used to receive and support the feet 38 of the ladder 36. In particular, the support apparatus 2 is positioned on the landing 40 and the feet 38 of the ladder 36 are held on the support apparatus 2.

Figure 8:
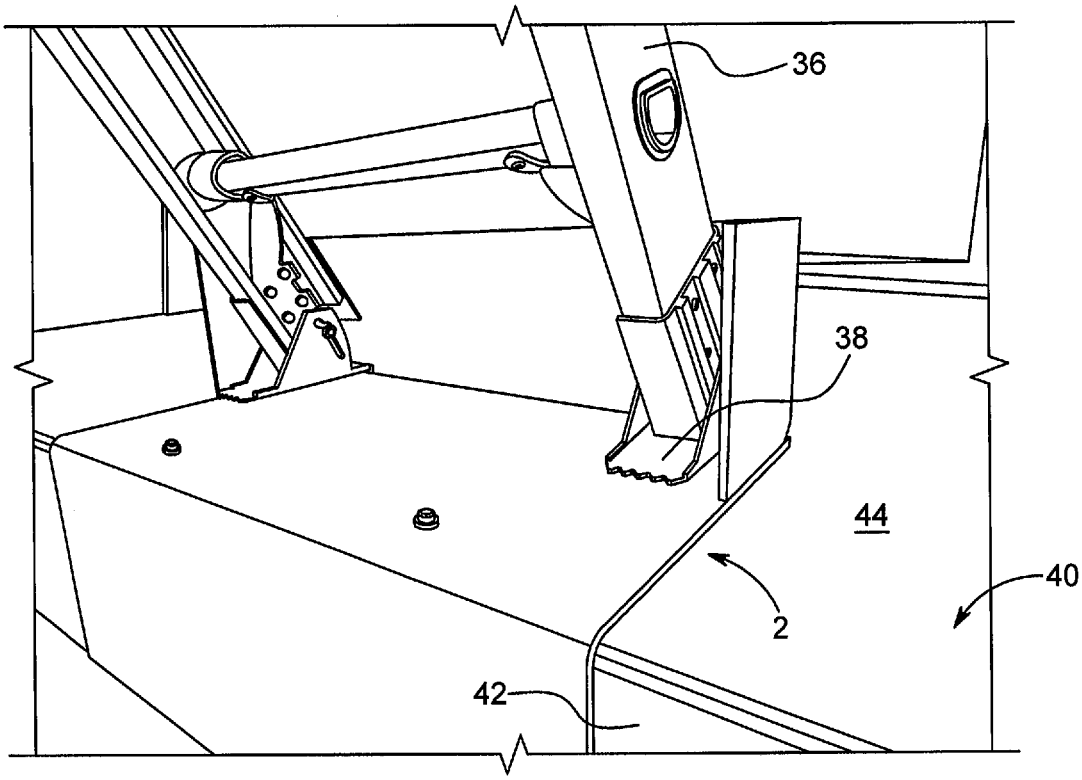
FIG. 8 is a front perspective view of the ladder landing support apparatus of FIG. 1 holding the feet of the ladder shown in FIG. 7.
Figure 9:
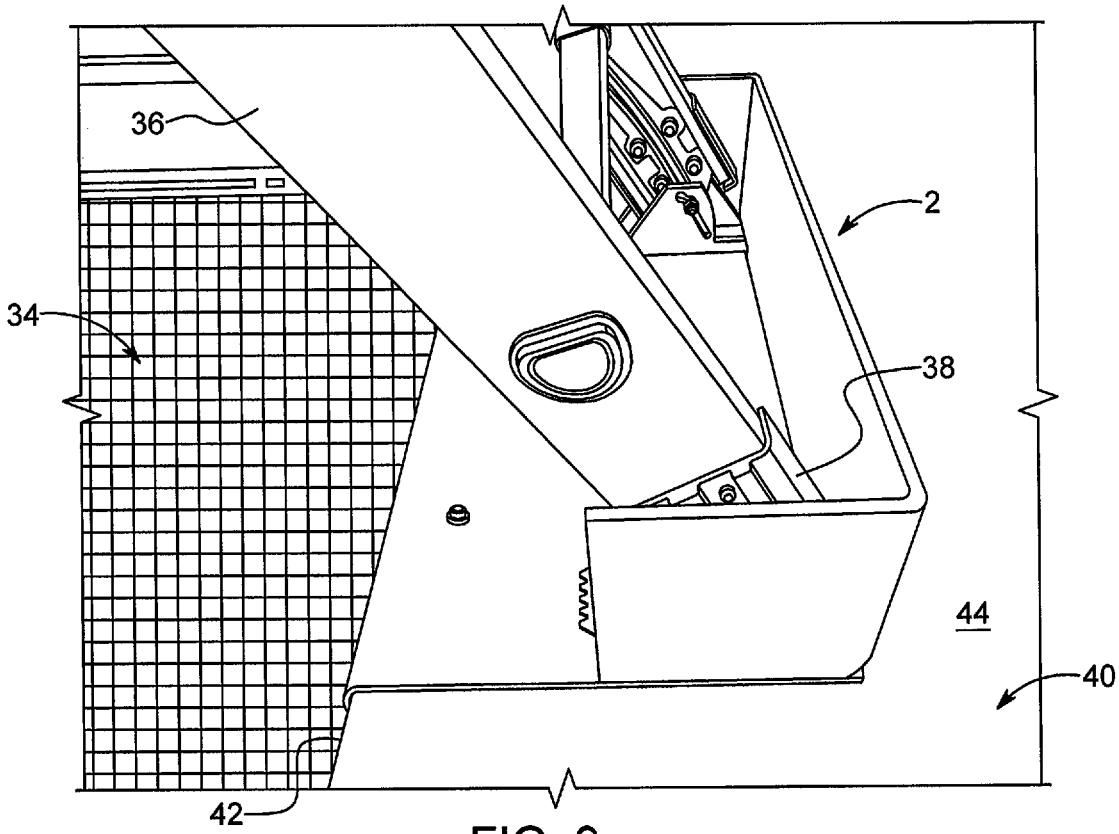
FIG. 9 is a side view of the ladder landing support apparatus of FIG. 1 holding the feet of the ladder shown in FIG. 7.
Figure 10:
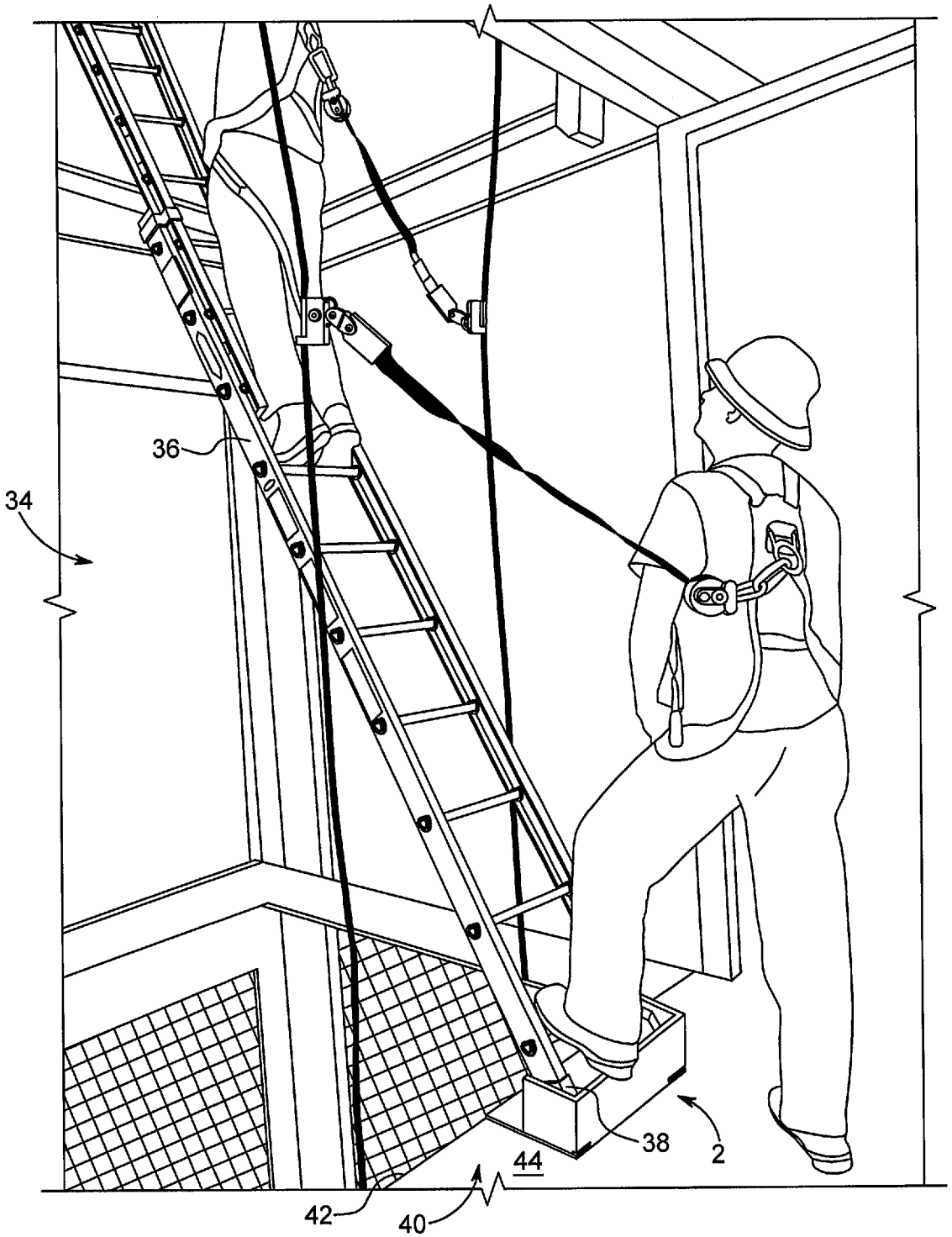
FIG. 10 is a perspective view of the ladder landing support apparatus of FIG. 1 supporting a ladder in an elevator hoistway with maintenance personnel using the ladder.

As shown in FIGS. 8 and 9, the support apparatus 2 is positioned on the edge of the landing or ledge 40 such that the second portion 10 of the base plate 4 extends over the edge of the landing or ledge 40. In this example, the rear side 9*b* of the second portion 10 of the base plate 4 is positioned against the vertical surface 42 of the landing 40, while the bottom side 11*b* of the first portion 8 of the base plate 4 is positioned against the horizontal surface 44 of the landing 40. The support apparatus 2 can be manually positioned by the maintenance person. If desired, after the support apparatus 2 has been positioned on the landing 40, the maintenance person may insert anchors into the slots 24, 26 of the support apparatus 2 to assist in holding the support apparatus 2 on the landing 40. The anchors may extend into the landing 40 to secure the support apparatus 2 thereto. It is to be understood, however, that it is not necessary for the anchors to be used to sufficiently hold the support apparatus 2 to the landing 40 to support the ladder 36.

After the support apparatus 2 has been properly positioned on the landing 40, the maintenance person can position the feet 38 of the ladder 36 on the top side 11*a* of the first portion 8 of the base plate 4. The feet 38 are positioned between the left and right portions 14, 16 of the ladder engaging part 6 on the base plate 4. The top end of the ladder 36 can then be leaned against the opposing wall of the elevator hoistway 34 to move the ladder 36 into a standing position. As the ladder 36 is rotated, the feet 38 may slide backwards towards the center portion 12 of the ladder engaging part 6. It is also contemplated that the maintenance person will initially place the feet 38 against the ladder engaging part 6 before rotating the ladder 36 to slide the feet 38 through the openings 30, 32. After the ladder 36 has been positioned in the standing position, the support apparatus 2 will prevent the ladder 36 from sliding on the landing 40, thereby ensuring that the maintenance person can safely move on the ladder 36 to install the component or fix the issue in the elevator hoistway 34 and/or elevator car. Due to the second portion 10 extending over the edge of the landing 40, the second portion 10 bears against the vertical surface 42 of the landing 40 to prevent the support apparatus 2 from sliding away from or rotating relative to the elevator hoistway 34 based on the feet 38 of the ladder 36 pushing against the ladder engaging part 6. In one example, the length of the first and second portions 8, 10 of the base plate 4 are optimized to provide an appropriate working angle when the ladder 36 is engaged with the support apparatus 2 and the back wall of the elevator hoistway 34. In one example, the center portion 12 of the ladder engaging part 6 can withstand more than 1,250 pounds of pressure. In one example, the weight of the ladder 36 itself on the support apparatus 2 also assists in holding the support apparatus 2 in place to prevent the ladder 36 from losing traction or sliding on the landing 40. In another example, as the maintenance person is positioning the feet 38 of the ladder 36 on the support apparatus 2, the feet 38 of the ladder 36 may be slid into the openings formed by the recesses 30, 32 defined in the ladder engaging part 6. As discussed above, the openings 30, 32 are sized and shaped to receive the feet 38 of the ladder 36 to provide further support for the ladder 36 on the support apparatus 2. The openings 30, 32 can be sized and dimensioned so that the support apparatus 2 will only work with specific ladders, or the openings 30, 32 may be sufficiently sized and shaped to receive the feet of any type of ladder. By inserting the feet 38 of the ladder 36 into the openings 30, 32, the feet 38 of the ladder 36 are also prevented from sliding, rocking, or moving laterally side to side relative to the landing 40.

Figure 11:
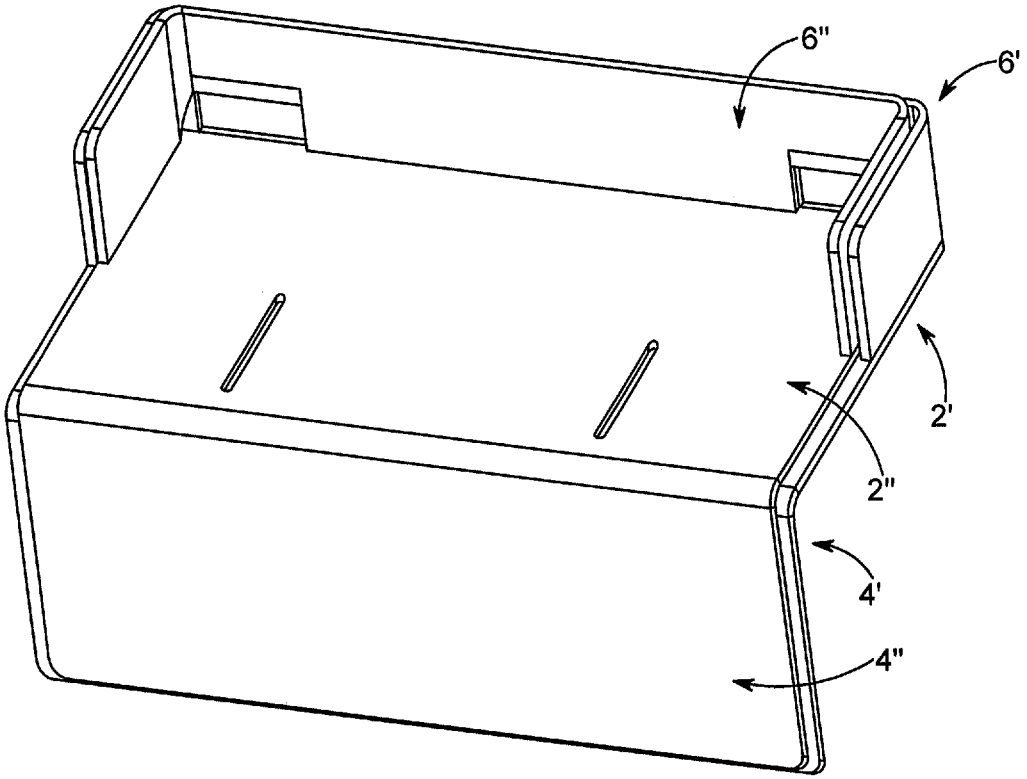
FIG. 11 is a perspective view of two ladder landing support apparatuses nested in one another.

With reference to FIG. 11, two support apparatuses 2', 2" nested one within the other are shown and described. In one example, one support apparatus 2" may be nested within another support apparatus 2' to permit maintenance personnel to carry or transport multiple support apparatuses 2', 2" without taking up a considerable amount of space. In certain situations, a technical or mechanical issue may require two maintenance personnel to access the elevator hoistway 34 or elevator car, which will require the use of two ladders 36 in the elevator hoistway 34. To reduce the amount of space that is occupied by the support apparatuses 2', 2" in the maintenance persons' toolboxes or to assist the maintenance persons in carrying the support apparatuses 2', 2" to the elevator hoistway 34, one support apparatus 2" may be nested within another support apparatus 2'. The width of the support apparatus 2" may be smaller than the width of the support apparatus 2' to permit the support apparatus 2" to rest within the support apparatus 2'. When the support apparatus 2" is nested within the support apparatus 2', the base plate 4" of the support apparatus 2" may be positioned on the top surface of the base plate 4' of the support apparatus 2'. In the nested position, the ladder engaging part 6" of the support apparatus 2" may be positioned within the ladder engaging part 6' of the support apparatus 2'. Although the width of the support apparatus 2" is less than the width of the support apparatus 2', the length of the base plate 4" is substantially equal to the length of the base plate 4' so that both support apparatuses 2', 2" are optimized to support the respective ladders 36 held on the support apparatuses 2', 2".

While several examples of a device and method for supporting a ladder in an elevator hoistway were shown in the accompanying figures and described in detail hereinabove, other examples will be apparent to, and readily made by, those skilled in the art without departing from the scope and spirit of the disclosure. Accordingly, the foregoing description is intended to be illustrative rather than restrictive. The apparatus of the present disclosure described hereinabove is defined by the appended claims and all changes to the disclosed apparatus that fall within the meaning and range of equivalency of the claims are to be embraced within their scope.

What is claimed is:

1. A ladder landing support apparatus for supporting a ladder in an elevator hoistway, the ladder landing support apparatus comprising:

an angled base plate including a first portion and a second portion defining an angle with the first portion, the second portion depending downward from a first end of the first portion; and a ladder engaging part extending upwardly from a top side of the first portion, the ladder engaging part being engageable with feet of a ladder so as to substantially prevent slippage thereof in a direction parallel to the first portion, wherein the angled base plate is angled to engage a ledge of the elevator hoistway such that the first portion is engageable with a top horizontal surface of the ledge and the second portion is engageable with a front vertical surface of the ledge to prevent the ladder landing support apparatus from sliding away from or rotating relative to the elevator hoistway, wherein the ladder engaging part is U-shaped comprising a center portion extending upward from a second end of the first portion opposite the first end of the first portion, a left portion extending from the center portion towards the first end of the first portion, and a right portion extending from the center portion towards the first end of the first portion, and wherein the center portion defines two spaced apart openings above the second end of the first position, the two spaced apart openings configured to receive at least a portion of the feet of the ladder through the two spaced apart openings.

2. The ladder landing support apparatus as claimed in claim 1, wherein the left portion and the right portion extend substantially perpendicular to the center portion.

3. The ladder landing support apparatus as claimed in claim 1, wherein the base plate and the ladder engaging part are formed as a monolithic structure.

4. The ladder landing support apparatus as claimed in claim 1, wherein the base plate and the ladder engaging part are separate components that are welded together.

5. The ladder landing support apparatus as claimed in claim 1, wherein the top side of the first portion of the base plate defines at least two spaced apart recesses shaped and configured to receive a foot of a ladder.

6. The ladder landing support apparatus as claimed in claim 1, wherein the first portion defines an angle of approximately 90° with the second portion.

7. The ladder landing support apparatus as claimed in claim 1, wherein at least one slot is defined in the base plate to receive mechanical fasteners to secure the first portion of the base plate with the top horizontal surface of the ledge.

8. The ladder landing support apparatus as claimed in claim 1, further comprising a nonslip grip surface formed or provided on a bottom side of the first portion of the base plate.

9. A ladder assembly for use in an elevator hoistway, the ladder assembly comprising:

a ladder comprising two feet; and a ladder landing support apparatus for supporting the ladder in the elevator hoistway, the ladder landing support apparatus comprising:

an angled base plate including a first portion and a second portion defining an angle with the first portion, the second portion depending downward from a first end of the first portion; and a ladder engaging part extending upwardly from a top side of the first portion, the ladder engaging part being engageable with the feet of a ladder so as to substantially prevent slippage thereof in a direction parallel to the first portion, wherein the angled base plate is angled to engage a ledge of the elevator hoistway such that the first portion is engageable with a top horizontal surface of the ledge and the second portion is engageable with a front vertical surface of the ledge to prevent the ladder landing support apparatus from sliding away from or rotating relative to the elevator hoistway, wherein the ladder engaging part is U-shaped comprising a center portion extending upward from a second end of the first portion opposite the first end of the first portion, a left portion extending from the center portion towards the first end of the first portion, and a right portion extending from the center portion towards the first end of the first portion, and wherein the center portion defines two spaced apart openings above the second end of the first position, the two spaced apart openings configured to receive at least a portion of the feet of the ladder through the two spaced apart openings.

10. The ladder assembly as claimed in claim 9, wherein the left portion and the right portion extend substantially perpendicular to the center portion.

11. The ladder assembly as claimed in claim 9, wherein the base plate and the ladder engaging part are formed as a monolithic structure.

12. The ladder assembly as claimed in claim 9, wherein the base plate and the ladder engaging part are separate components that are welded together.

13. The ladder assembly as claimed in claim 9, wherein the top side of the first portion of the base plate defines at least two spaced apart recesses shaped and configured to receive one of the feet of the ladder.

14. The ladder assembly as claimed in claim 9, wherein the first portion defines an angle of approximately 90° with the second portion.

15. The ladder assembly as claimed in claim 9, wherein at least one slot is defined in the base plate to receive mechanical fasteners to secure the first portion of the base plate with the top horizontal surface of the ledge.

16. The ladder assembly as claimed in claim 9, further comprising a second ladder landing support apparatus provided and configured to be nested within the ladder landing support apparatus.

17. A ladder landing support apparatus for supporting a ladder in an elevator hoistway, the ladder landing support apparatus comprising:

an angled base plate including a first portion and a second portion defining an angle with the first portion, the second portion depending downward from a first end of the first portion; and a ladder engaging part extending upwardly from a top side of the first portion, the ladder engaging part being engageable with feet of a ladder so as to substantially prevent slippage thereof in a direction parallel to the first portion, wherein the angled base plate is angled to engage a ledge of the elevator hoistway such that the first portion is engageable with a top horizontal surface of the ledge and the second portion is engageable with a front vertical surface of the ledge to prevent the ladder landing support apparatus from sliding away from or rotating relative to the elevator hoistway, wherein the ladder engaging part is U-shaped comprising a center portion extending upward from a second end of the first portion opposite the first end of the first portion, a left portion extending from the center portion towards the first end of the first portion, and a right portion extending from the center portion towards the first end of the first portion, wherein the center portion defines two spaced apart openings above the second end of the first position, the two spaced apart openings configured to receive at least a portion of the feet of the ladder through the two spaced apart openings, and wherein the center portion of the ladder engaging part is substantially parallel with the second portion of the angled base plate.

* * * * *